US007314199B1

(12) United States Patent
Ward

(10) Patent No.: US 7,314,199 B1
(45) Date of Patent: Jan. 1, 2008

(54) FOLDING ARCHERY BOW STAND

(76) Inventor: David L. Ward, 9425 Taylor, Overland Park, KS (US) 66212

( * ) Notice: Subject to any disclaimer, the term of this patent is extended or adjusted under 35 U.S.C. 154(b) by 0 days.

(21) Appl. No.: 11/026,980

(22) Filed: Dec. 31, 2004

(51) Int. Cl.
*F16M 11/38* (2006.01)

(52) U.S. Cl. ..... 248/166; 248/150

(58) Field of Classification Search ..... 248/460, 248/461, 465, 528, 529, 533, 150, 151, 156, 248/165, 166; 211/195, 198; 403/66, 85, 403/157; 16/356, 355
See application file for complete search history.

(56) References Cited

U.S. PATENT DOCUMENTS

| | | | | |
|---|---|---|---|---|
| 2,522,345 | A * | 9/1950 | Cashiopp | 248/121 |
| 3,584,820 | A | 6/1971 | Butcher, Sr. | |
| 3,926,393 | A | 12/1975 | Tainsh | |
| 3,958,786 | A * | 5/1976 | Mann | 248/176.3 |
| 3,991,780 | A | 11/1976 | Maroski, Jr. | |
| 4,360,179 | A | 11/1982 | Roberts | |
| 4,611,945 | A * | 9/1986 | Diego | 403/61 |
| 4,846,140 | A | 7/1989 | DiMartino | |
| 5,039,052 | A | 8/1991 | Carafice | |
| 5,106,044 | A | 4/1992 | Regard, III et al. | |
| 5,111,800 | A | 5/1992 | Reynolds | |
| 5,340,065 | A * | 8/1994 | Thomas | 248/150 |
| 5,636,754 | A | 6/1997 | Ennis | |
| D382,034 | S | 8/1997 | Dullinger | |
| 5,775,658 | A | 7/1998 | Englehardt | |
| 5,895,169 | A * | 4/1999 | Holm et al. | 404/9 |
| 6,205,992 | B1 | 3/2001 | Meeks et al. | |
| 6,353,969 | B1 * | 3/2002 | LeMole | 16/352 |
| 6,497,327 | B1 | 12/2002 | Rindfleisch | |
| 2002/0066446 | A1 | 6/2002 | Kesti | |

* cited by examiner

*Primary Examiner*—A. Joseph Wujciak, III
(74) *Attorney, Agent, or Firm*—Kenneth W Iles

(57) ABSTRACT

A bow stand includes an upper section and a lower section connected by an articulating joint that allows the upper and lower sections to be folded flat against each other for compact storage. A point at the lower end of the lower section is pushed into the ground and an archer's bow is set into a U-shaped bracket mounted at the top of the top section for temporarily storing the bow without having it touch the ground.

12 Claims, 4 Drawing Sheets

34
32
30
33
18
42
46
50
36
38
40
20
44
22
10
26
28
~16~
24
12

FOLDING ARCHERY BOW STAND

CROSS-REFERENCE TO RELATED APPLICATIONS

Not Applicable.

STATEMENT REGARDING FEDERALLY SPONSORED RESEARCH OR DEVELOPMENT

Not applicable.

SEQUENCE LISTING

Not applicable

BACKGROUND OF THE INVENTION

The present invention is related to an apparatus for conveniently holding an archery bow off the ground in the field. More particularly, the present invention is a stake having a bracket at the top for holding the bow, a sharpened end for inserting the stake into the ground and a means for folding the stake for convenience and safety.

DESCRIPTION OF THE RELATED ART INCLUDING INFORMATION DISCLOSED UNDER 37 C.F.R. 1.97 and 1.98.

Archery bow hunting has become increasingly popular. When archers rest or wait for game, they often want to put the bow down. With many archery bows being very expensive, however, most archers want to put the bow down in such a fashion that it will not be damaged. Lying the bow on the ground leaves it susceptible to being stepped on or becoming contaminated by dirt, branches or the like, all of which may affect the accuracy of the bow. Alternatively, the archer may lean the bow against a tree or fence. Due to the shape and weight distribution along the bow, however, leaning the bow against an object places the bow into an unstable position from which it is likely to fall to the ground, adversely affecting the accuracy of the bow and perhaps damaging it.

Therefore, the causal practice of lying the bow on the ground or leaning it against an object are not satisfactory. The need for an archery bow stand to place the bow in during rest has lead to several patented designs for archery bow stands.

Addressing a similar problem, Rindfleish devised a cylindrical stake having a pointed lower end and a U-shaped bracket attached on the top. The stake is inserted into the ground and a golf club handle is cradled in the U-shaped bracket, while the head of the golf club rests on the ground. This device is disclosed in U.S. Pat. No. 6,497,327. Such a device, however, would be dangerous and awkward for an archer in the open field to use because the stake is relatively long and the exposed pointed end of the stake is dangerous. Further, it is desirable for such a stand to hold the bow without having the bow contact the ground at all and the thin cylindrical stake portion of Rindfleish would not provide the lateral support needed to retain the relatively heavy archery bow. Thus, a similar device would be undesirable in archery bow hunting or other use in the field.

An archery bow stand is disclosed in U.S. Pat. No. 6,205,992, issued to Meeks et al., which consists of a pair of legs that swivel apart and that are connected to a damper rod, or stabilizer rod, that extends forward of the bow and perpendicular to the general vertical line of the bow. When the legs are deployed, they form a tripod, with the lower end of bow forming the third leg. This arrangement leaves one end of the bow in contact with the ground. It also adds weight to the bow and can alter the balance and accuracy of the bow, as well as the performance of the damper rod in reducing accuracy robbing vibration of the bow when it is fired.

The bow holder of Englehardt, U.S. Pat. No. 5,775,658, must be attached to an external member, such as a plank or exposed timber and hence is wholly unsuitable to use in the open field.

The Reynolds bow holder, U.S. Pat. No. 5,111,800, includes a stake for inserting into the ground and a pair of vertically spaced pegs that project outwardly from the stake in the same direction and that are parallel to each other, with each peg having elaborate and confusing adjustments. In addition, the pointed end of the stake is permanently attached to the main body of the stake, increasing the danger of carrying it.

DiMartino, U.S. Pat. No. 4,846,140, includes a stake that is inserted into the ground, with a bend in the stake rod and a complex mounting bracket in the form of a clamp on the top of the stake with the bow being clamped into the bracket and held off the ground. This device is relatively heavy and awkward to carry and has a dangerously exposed sharpened end on the stake.

Other related references include complex stands, long stands, clamps and so forth. All are awkward to carry or to use, add significant extra weight to the archer's equipment and most include dangerously exposed points on the lower end of the stake. It would be very easy for an archer to fall onto the pointed end of the stake while carrying it, risking serious energy.

Therefore, there is a need for an archery bow stand that can be carried without an exposed point; that can be folded to provide a smaller more convenience size for carrying or storage; that is simple to use with any bow and that can be conveniently used in the field.

BRIEF SUMMARY OF THE INVENTION

Accordingly, it is a primary object of the present invention to provide an archery bow stand that can be carried without an exposed point.

It is another object of the present invention to provide an archery bow stand that can be folded to provide a smaller more convenience size for carrying or storage.

It is another object of the present invention to provide an archery bow stand that is simple to use with any bow.

It is another object of the present invention to provide an archery bow stand that can be conveniently used in the field.

These objects are achieved by providing an archery bow stand comprising a stake having a body of rectangular cross section with a pointed lower end for penetrating into the ground and a U-shaped bracket on the top for holding a bow off the ground. A joint between the upper and lower portions of the stake allow the stake to be folded against itself in a virtually flat configuration for transportation or storage. In the folded position, the pointed end is relatively safely stored because the point does not extend beyond the flat end of the member it is folded against. That is, although the point is visible, it cannot penetrated into anything.

A U-shaped slide lock in the form of a U-shaped channel bracket slides up and down the stake and when it is placed into the locking position, it covers the joint between the upper and lower stake portions, preventing the stake from folding when it is pushed into the ground or is supporting an archery bow.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
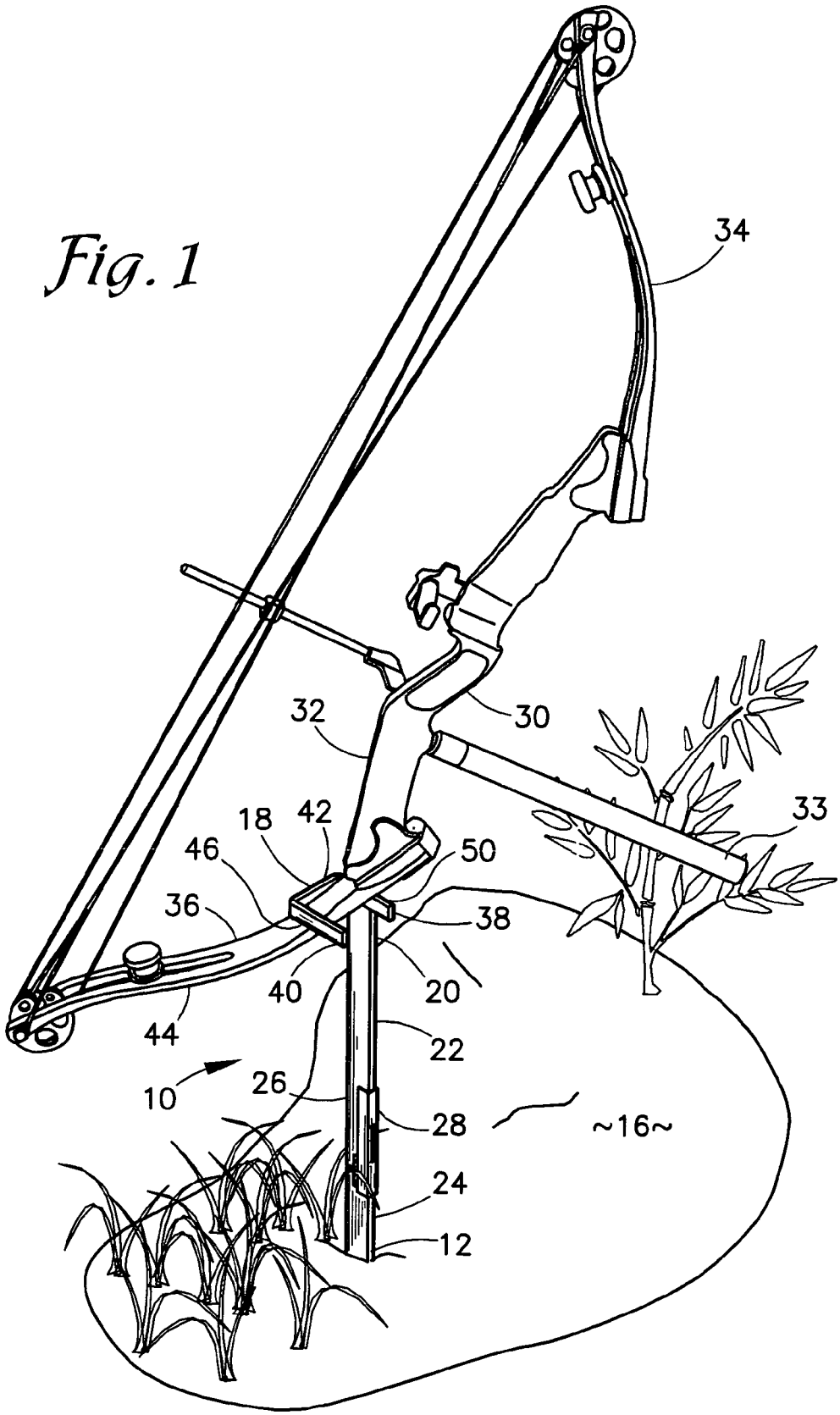
FIG. 1 is an isometric view of a folding archery bow stand according to the present invention showing the device in use supporting an archery bow.

Referring to FIG. 1, the folding archery bow stand, or bow stand, 10 includes a lower end 12 having a pointed end 14 (e.g., FIG. 2) that is pushed into the ground 16 so that the bow stand 10 is more or less vertical. A U-shaped bracket 18 is fastened to the upper end 20 of the bow stand 10. The bow stand 10 includes an upper section 22 and a lower section 24 that are connected by an articulating joint 26 that allows the upper and lower sections 22, 24 to be folded against each other. A U-shaped channel slide lock 28 is slid over the articulating joint 26 to lock the upper and lower sections 22, 24 into a unified single stake strong enough to be pushed into the ground 16 and to hold an archery bow 30.

Still referring to FIG. 1, the bow 30 includes a riser section 32 fitted with a forward projecting stabilizer 33 and an upper limb 34 and a lower limb 36, both connected to the riser section 32 conventionally. The bow 30 can be placed into the U-shaped bracket 18 in any fashion that maintains the bow 30 in an upright position. It is preferred, however, to place the bow 30 in the position shown in FIG. 1 in which the bow 30 is suspended by the U-shaped bracket 18 and does not contact the ground 16.

Figure 2:
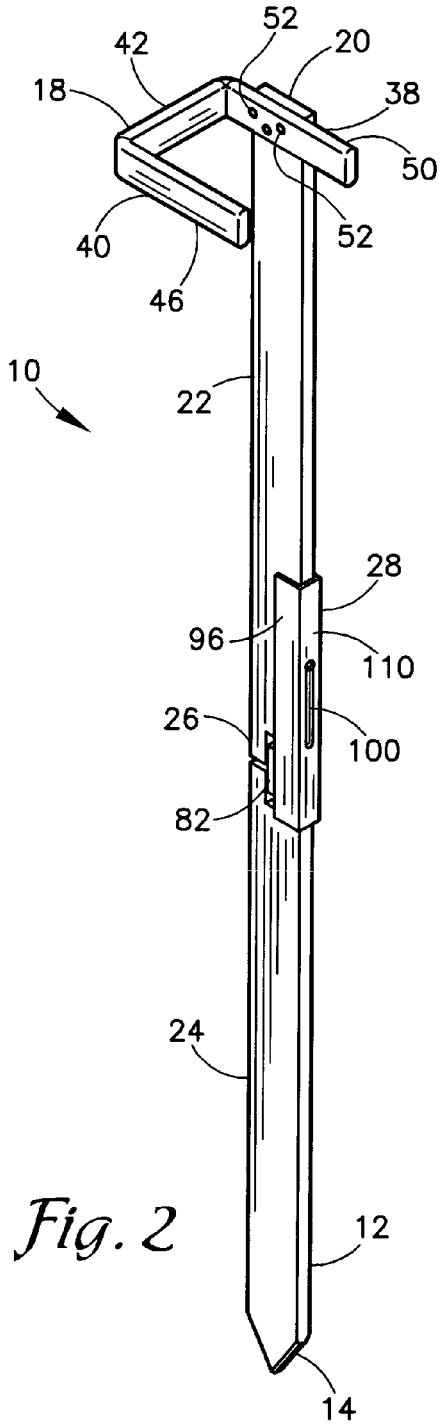
FIG. 2 is an isometric view of the folding archery bow stand of FIG. 1 shown in the unfolded and locked position ready for use.

Referring to FIGS. 1, 2, the U-shaped bracket 18 includes a proximal leg 38 that is directly fastened to the upper end 20 of the bow stand 10 and a distal leg 40 that is parallel to the proximal leg 38 with the two legs 38, 40 connected by the straight base connector portion 42. The general plane of the bracket 18 is perpendicular to the upper section 22, that is, if the stake bow stand 10 is vertical, as is normally the case when the bow stand is inserted into the ground 16 for use, then the bracket 18 is horizontal, as shown in, for example, FIGS. 1-3, 6. The lower limb 36 of the archery bow 30 includes an upper surface 44 that contacts the lower edge 46 of the distal leg 40 and a lower surface 48 that contacts the upper edge 50 of the proximal leg 38, thereby holding the lower limb 36 in a bind with most of the weight of the archery bow 30 lying toward the stabilizer 33, resulting in most of the weight of the archery bow being cantilevered over the bow stand 10, providing an equilibrium position in which the archery bow 30 is fully suspended above the ground 16.

Figure 3:
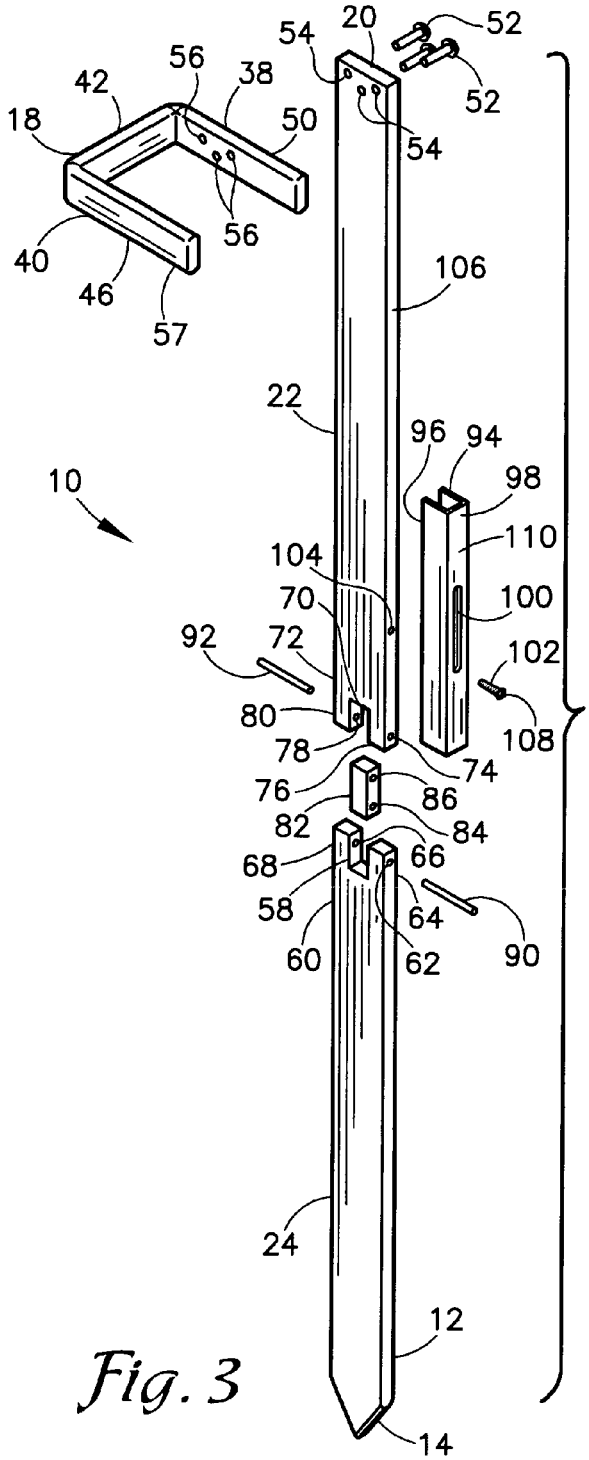
FIG. 3 is an exploded isometric view of the folding archery bow stand of FIG. 1.

Referring to FIG. 3, the U-shaped bracket 18 is fastened to the upper end 20 of the bow stand 10 by three rivets 52 arranged in a triangular shape, which are inserted through the aligned apertures 54 in the stake adjacent to the upper end 20 and the corresponding apertures 56 in the proximal leg 38 of the U-shaped bracket 18. The U-shaped bracket is coated with tool dip 57 or other suitable padding material to prevent marring the archery bow 30.

Still referring to FIG. 3, the articulating joint 26 includes a squared-off U-shaped lower notch 58 centered in the upper end 60 of the lower section 24 and a right-hand bore 62 through the right-hand leg 64 of the notch 58 and an aligned left-hand bore 66 though the left-hand leg 68 of the notch 58. A corresponding identically shaped and dimensioned squared off U-shaped upper notch 70 is centered in the lower end 72 of the upper section 22 and a right-hand bore 74 through the right-hand leg 76 of the notch 70 and an aligned left-hand bore 78 through the left-hand leg 80 of the notch 70. Interposed between the two notches 58, 70 is a joint block 82 dimensioned to fit into the notches 58, 70, and having a lower bore 84 though it and a parallel upper bore 86 through it.

Still referring to FIG. 3, the bow stand 10 is assembled by inserting the lower pin 90 through the bores 62, 84, 66 and the upper pin 92 through the bores 74, 86, 78. The pins 90, 92 fit tightly enough that they will not fall out, and may include positive stops on both ends, but loosely enough that all parts pinned by them will pivot about the pins 90, 92. The lower end of the joint block 82 is fitted into the lower notch 58 and the upper end of the joint block 82 is fitted into the upper notch 70.

Still referring to FIG. 3, the upper section 22 and lower section 24 will not form a rigid bow stand 10 due to pivoting about the pins 90, 92, but they are made rigid by the U-shaped channel slide lock 28, which is slid over either the upper section 22 or lower section 24 before other hardware is connected to them. The U-shaped channel slide lock 28 includes a rear side wall 94 and a front side wall 96, which are spaced apart and parallel and are connected by the edge side wall 98, that is, the slide lock 28 is conveniently formed from a length of extruded channel member. A slot 100 is cut into the edge side wall 98 and a machine screw 100 is inserted into the slot 100 and screwed into the aperture 104 on the edge 106 of the upper section 22 of the bow stand 10. The slot is narrower than the diameter of the head of the screw 100, protrudes outwardly such that the lower should of the head 108 of the screw 100 rides on the outer surface 110 of the slide lock 28, which, in combination with the screw 100, serves as stop mechanism that confines the reciprocal movement of the slide lock 28 to a desired range that allows the slide lock 28 to be moved between a locked position covering the articulating joint 26 as shown in, for example, FIGS. 1, 6 to an unlocked position free of the articulating joint 26 as shown in, for example FIGS. 3-5, in which the slide lock 28 has been slid upward. The slide lock 28 could as well be slid downward to unlock the articulating joint 26.

Figure 4:
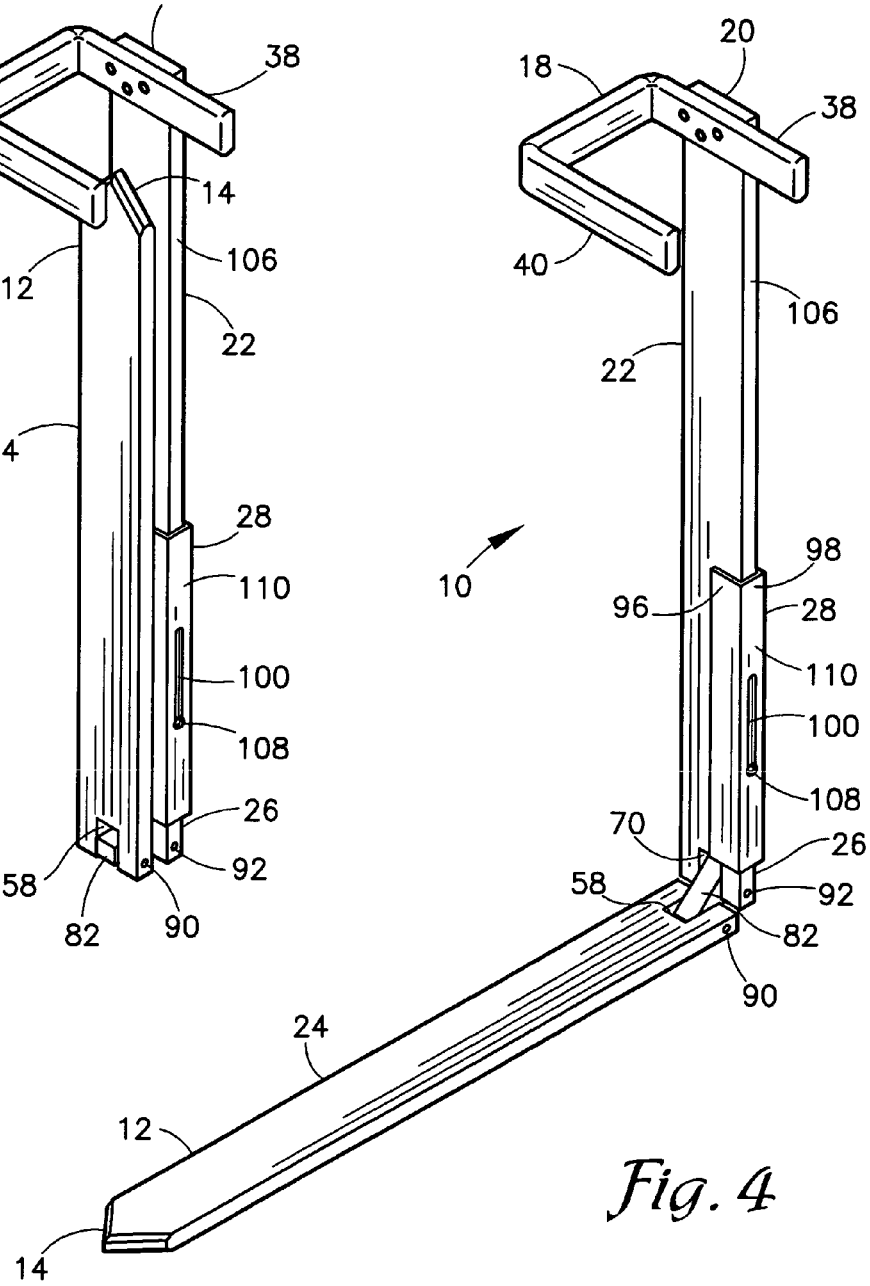
FIG. 4 is an isometric view of the folding archery bow stand of FIG. 1 shown in an intermediate position between an unfolded position and a fully folded position.

Referring to FIG. 4, the bow stand 10 is shown with the slide lock 28 moved to its highest position free from the articulating joint 26, which has been folded into an intermediate position between opened and closed with the upper and lower sections 22, 24 lying at about 45° to one another.

Figure 5:
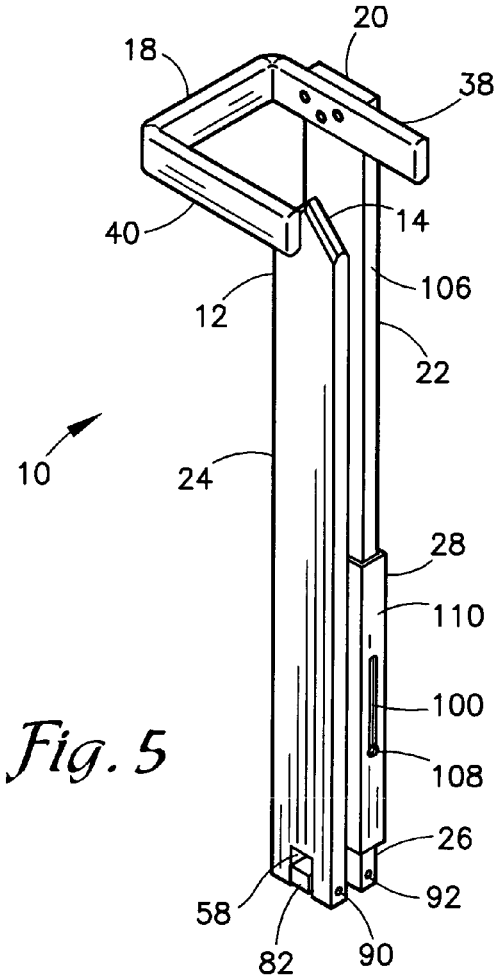
FIG. 5 is an isometric view of the folding archery bow stand of FIG. 1 shown in the fully folded position.

Referring to FIG. 5, the bow stand 10 is shown in its fully folded closed position with the upper section 22 and lower section 22 touching each other in full contact. The pointed end 14 is pointing upward and is not exposed, reducing the risk of injury from it. In the folded or collapsed position, the bow stand 10 can conveniently be carried in a sheath on the archer's belt, or in a pocket of his clothes.

Figure 6:
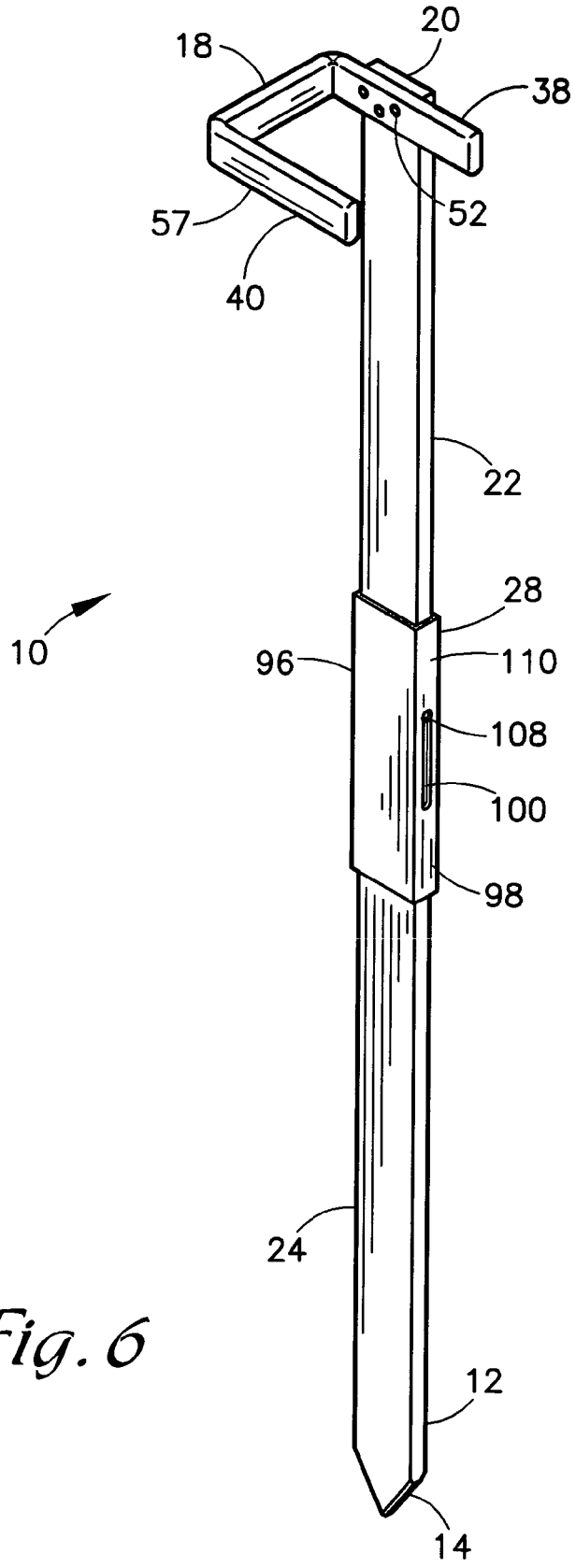
FIG. 6 is an isometric view of the folding archery bow stand of FIG. 1 having an alternative locking mechanism for retaining the folding archery bow stand in its unfolded state.

Referring to FIG. 6, the bow stand 10 is shown fully unfolded, with the slide lock 28 slid downward as far as possible so that the screw head 108 contacts the upper end of the slot 100, locking the articulating joint 26 and securing the bow stand 10 for insertion into the ground 16 for use. In this position, the upper section 22 and the separate lower section 24 are aligned along a single longitudinal axis to define a stake having a straight single axis.

The upper and lower sections 22, 24, the slide lock 26 and the bracket 28 and the joint block 82 are all conveniently made of aluminum bar stock, which may be hardened. The pins 90, 92 and the screw 102 are conveniently made of steel.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A stand comprising:

a. an upper section;

b. a separate lower section;

c. means for connecting said upper section and said separate lower section, said connecting means further comprises an articulated joint wherein said articulated joint further comprises a joint block fitted into a lower notch in an upper end of said separate lower section and secured into said lower notch by a lower pin inserted through a lower bore in said separate lower section and secured into an upper notch in a lower end of said upper section by an upper pin inserted though an upper bore in said joint block.

2. A stand in accordance with claim 1 further comprising an aperture through a left-hand leg and an aperture through a right-hand leg of said upper notch and an aperture through a left-hand leg and an aperture through a right-hand leg of said lower notch.

3. A stand in accordance with claim 1 further comprising means for locking said stand in an upright position.

4. A stand in accordance with claim 3 wherein said locking means further comprises a slide lock fitted over a portion of said upper section of said stand in a non-locking position.

5. A stand in accordance with claim 4 further comprising means for limiting the travel of said slide lock along said upper section and means for stopping the travel of said slide lock along said section.

6. A stand in accordance with claim 1 further comprising means for holding an object adjacent to a top end of said upper section.

7. A stand in accordance with claim 6 wherein said holding means further comprises a U-shaped bracket fixed to an upper end of said upper section.

8. A stand in accordance with claim 7 wherein said U-shaped bracket further comprises a proximal leg fixed to said upper end of said upper section and the general plane of said bracket is perpendicular to said upper section.

9. A stand comprising:

a. an upper section, b. a separate lower section;

c. means for connecting said upper section and said separate lower section, said connecting means comprising an articulated joint between said upper section fastened to a lower portion of said upper section and said separate lower section, fastened to an upper portion of said separate lower section wherein said articulated joint further comprises a joint block fitted into a lower notch in an upper end of said separate lower section and secured into said lower notch by a lower pin inserted through a lower bore in said separate lower section and secured into an upper notch in a lower end of said upper section by an upper pin inserted though an upper bore in said joint block; and d. means for locking said upper and said separate lower section into an upright position with said upper section and said separate lower section aligned along a single axis wherein said locking means further comprises a slide lock slidable attached on outside of one of the sections.

10. A stand in accordance with claim 9 further comprising an aperture through a left-hand leg and an aperture through a right-hand leg of said upper notch and an aperture through a left-hand leg and an aperture through a right-hand leg of said lower notch.

11. A stand comprising:

a. an upper section;

b. a separate lower section;

c. means for connecting said upper section and said separate lower section, said connecting means comprising an articulated joint, said articulated joint further comprising a joint block fitted into a lower notch in an upper end of said separate lower section and secured into said lower notch by a lower pin inserted through a lower bore in said separate lower section and secured into an upper notch in a lower end of said upper section by an upper pin inserted though an upper bore in said joint block and an aperture through a left-hand leg and an aperture through a right-hand leg of said upper notch and an aperture through a left-hand leg and an aperture through a right-hand leg of said lower notch, with said upper pin seated in said aperture in left-hand leg and said aperture in said right-hand leg of said upper notch and said lower pin seated in said aperture of said left-hand leg and in said aperture of said right-hand leg of said lower notch;

d. mean for locking said upper and said separate lower section into an upright position with said upper section and said separate lower section aligned along a single axis; and e. means for holding a separate article connected to an upper portion of said upper section.

12. A stand in accordance with claim 11 wherein said holding means further comprises a U-shaped bracket fixed to an upper end of said upper section and lying generally in plane perpendicular to said axis of said stand.

* * * * *